US006378505B1

(12) United States Patent
Doering et al.

(10) Patent No.: US 6,378,505 B1
(45) Date of Patent: Apr. 30, 2002

(54) FUEL TANK PRESSURE CONTROL SYSTEM

(75) Inventors: Jeffrey Allen Doering, Canton; Brent Edward Sealy, Dearborn; Jae Doo Chung, Westland; Marianne L. Vykydal, Onsted; Patrick Joseph Curran, Northville, all of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/639,651

(22) Filed: Aug. 15, 2000

(51) Int. Cl.[7] ..... F02M 33/02
(52) U.S. Cl. ..... 123/520; 123/198 D
(58) Field of Search ..... 123/516, 518, 123/519, 520, 198 D; 73/40

(56) References Cited

U.S. PATENT DOCUMENTS

| | | | | |
|---|---|---|---|---|
| 4,862,856 A | | 9/1989 | Yokoe et al. | |
| 5,021,071 A | | 6/1991 | Reddy | |
| 5,048,492 A | | 9/1991 | Davenport et al. | |
| 5,148,793 A | | 9/1992 | Reddy | |
| 5,197,442 A | | 3/1993 | Blumenstock et al. | |
| 5,275,145 A | | 1/1994 | Tuckey | |
| 5,280,775 A | | 1/1994 | Tanamura et al. | |
| 5,357,934 A | | 10/1994 | Iida et al. | |
| 5,363,828 A | | 11/1994 | Yamashita et al. | |
| 5,419,299 A | * | 5/1995 | Fukasawa et al. | 123/520 |
| 5,450,834 A | | 9/1995 | Yamanaka et al. | |
| 5,488,936 A | | 2/1996 | Rychlick et al. | |
| 5,584,278 A | | 12/1996 | Satoh et al. | |
| 5,614,665 A | | 3/1997 | Curran et al. | |
| 5,647,333 A | | 7/1997 | Mukai | |
| 5,739,421 A | * | 4/1998 | Iochi et al. | 73/49.7 |
| 5,750,888 A | | 5/1998 | Matsumoto et al. | |
| 5,960,817 A | | 10/1999 | Johansen et al. | |
| 5,970,957 A | | 10/1999 | Fried et al. | |
| 6,041,761 A | | 3/2000 | Uto et al. | |
| 6,289,721 B1 | * | 9/2001 | Blumenstock | 73/40 |

* cited by examiner

*Primary Examiner*—Willis R. Wolfe
*Assistant Examiner*—Mahmoud Gimie
(74) *Attorney, Agent, or Firm*—John D. Russell; Allan J. Lippa

(57) ABSTRACT

A method is presented for diagnosing a condition in the fuel vapor purge system. The engine, the fuel tank and the carbon canister are connected in a three-way connection. The engine can be selectively isolated by a purge control valve, and the fuel tank can be selectively isolated by a fuel tank control valve. The operation of both valves is coordinated by an electronic engine controller. By isolating the fuel tank, and comparing the actual rate of change of the internal tank pressure (from the tank pressure sensor) to the estimated rate of change (from engine operating conditions) it is possible to determine if a condition occurred, and whether it is in the tank or in the vapor purge lines.

18 Claims, 4 Drawing Sheets

FUEL TANK PRESSURE CONTROL SYSTEM

FIELD OF THE INVENTION

The invention relates to a system and method for controlling fuel vapor purging in a vehicle equipped with an internal combustion engine coupled to a fuel tank coupled to a purging canister.

BACKGROUND OF THE INVENTION

Vehicles typically have various devices installed for preventing and controlling emissions. One of the sources of emissions are fuel vapors generated in the fuel tank due to temperature cycling and fuel vapors that are displaced in the process of refueling the fuel tank. In order to remove these vapors from the fuel tank, vehicles are equipped with fuel emission control systems, typically including a fuel vapor storage device, which in this example is an activated charcoal filled canister for absorbing the evaporative emissions. One such system is described in U.S. Pat. No. 5,048,492, where a three-way connection between the fuel tank, the canister and the engine is established. The engine is connected to the fuel tank and the carbon canister via a communication passage. Vapors generated in the fuel tank are continuously drawn into the canister where the fuel component (usually hydrocarbons) is absorbed on the carbon granules, and the air is expelled into the atmosphere. A purge control valve is located in the intake manifold of the engine between the engine and the canister. A controller selectively opens and closes the purge control valve to allow purged fuel vapors from the canister to enter the engine. When the valve opens, manifold vacuum from the engine draws air from the atmosphere back into the canister, thus purging the fuel vapors into the engine, where they are burned.

The inventors herein have recognized a disadvantage with the above approaches. Namely, since vapors are always being generated in the fuel tank, and therefore are always exiting the tank due to the fact that it is not isolated, it is not possible to detect fuel tank conditions that may lead to fuel vapor emission into the atmosphere such as a missing or improperly installed fuel cap.

SUMMARY OF THE INVENTION

An object of the present invention is to develop better diagnostic procedures of the fuel vapor purging system.

The above object is achieved and disadvantages of prior approaches overcome by a method for detecting a fuel tank condition in a vehicle, the method consisting of: isolating the fuel tank from a fuel vapor storage device and from an engine; calculating an estimated rate of change of a fuel tank pressure based on an operating condition when the fuel tank is isolated; calculating an actual rate of change of said fuel tank pressure when the fuel tank is isolated based on an information from a fuel tank pressure sensor; and indicating the fuel tank condition if said actual rate of change exceeds said estimated rate of change by a value greater than a preselected constant.

An advantage of the above aspect of the invention is that the proposed system configuration allows isolating the fuel tank for diagnostic purposes. By isolating the fuel tank, system diagnostics will be able to tell whether the fuel vapor emission into the atmosphere is occurring due to a fuel tank condition or is caused by some other component of the fuel vapor purge system. This e will decrease the time required to diagnose and repair the fuel vapor purge system, and will therefore improve service time and cost.

Other objects, features and advantages of the present invention will be readily appreciated by the reader of this specification.

BRIEF DESCRIPTION OF THE DRAWINGS

The object and advantages claimed herein will be more readily understood by reading an example of an embodiment in which the invention is used to advantage with reference to the following drawings herein:

DESCRIPTION OF THE INVENTION

Figure 1:
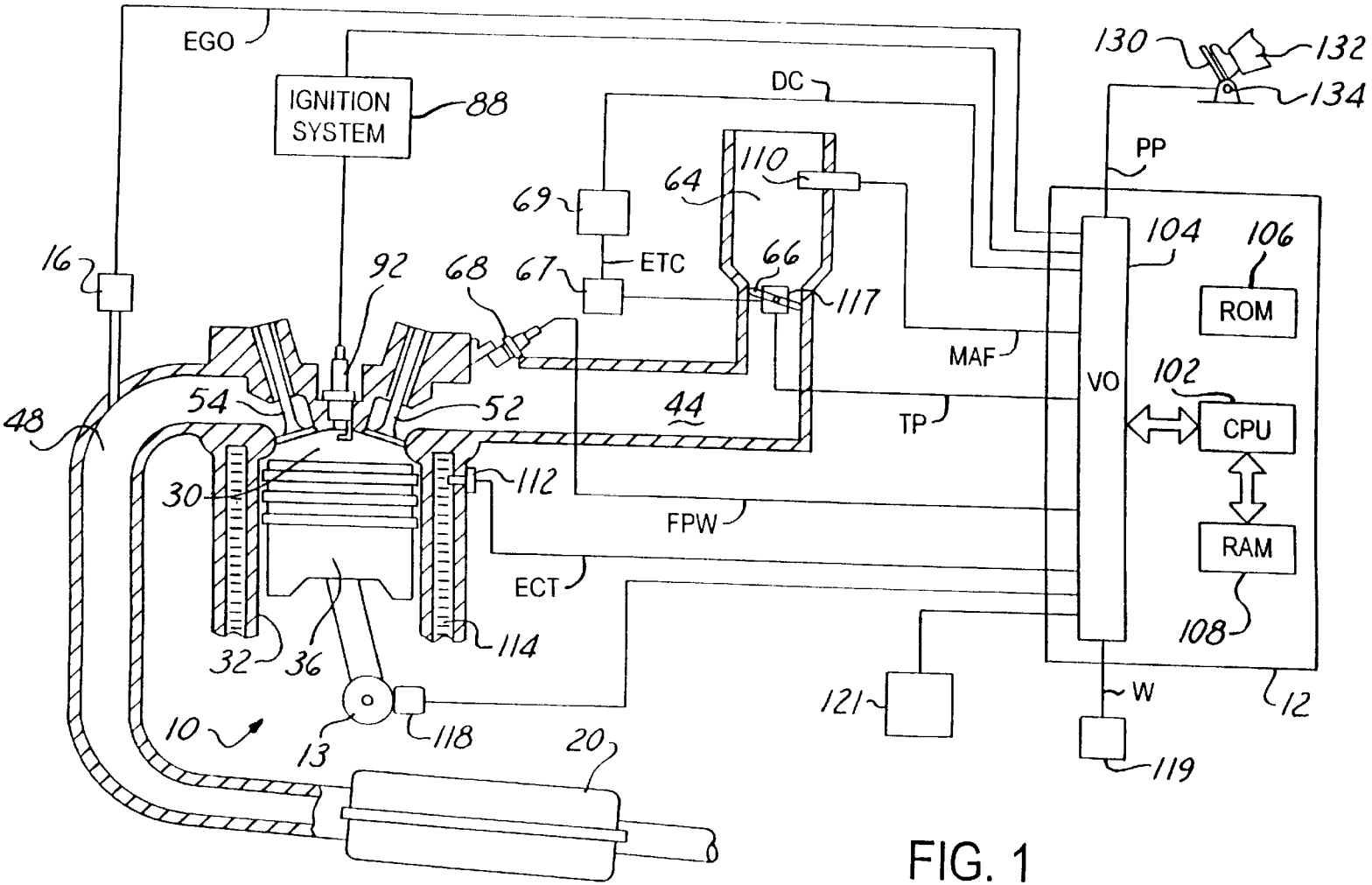
FIG. 1 is a block diagram of an engine in which the invention is used to advantage.

Internal combustion engine 10, having a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 13. Combustion chamber 30 communicates with intake manifold 44 and exhaust manifold 48 via respective intake valve 52 and exhaust valve 54. Exhaust gas oxygen sensor 16 is coupled to exhaust manifold 48 of engine 10 upstream of catalytic converter 20. In a preferred embodiment, sensor 16 is a HEGO sensor as is known to those skilled in the art.

Intake manifold 44 communicates with throttle body 64 via throttle plate 66. Throttle plate 66 is controlled by electric motor 67, which receives a signal from ETC driver 69. ETC driver 69 receives control signal (DC) from controller 12. Intake manifold 44 is also shown having fuel injector 68 coupled thereto for delivering fuel in proportion to the pulse width of signal (fpw) from controller 12. Fuel is delivered to fuel injector 68 by a conventional fuel system (not shown) including a fuel tank, fuel pump, and fuel rail (not shown).

Engine 10 further includes conventional distributorless ignition system 88 to provide ignition spark to combustion chamber 30 via spark plug 92 in response to controller 12. In the embodiment described herein, controller 12 is a conventional microcomputer including: microprocessor unit 102, input/output ports 104, electronic memory chip 106, which is an electronically programmable memory in this particular example, random access memory 108, and a conventional data bus.

Controller 12 receives various signals from sensors coupled to engine 10, in addition to those signals previously discussed, including: measurements of inducted mass air flow (MAF) from mass air flow sensor 110 coupled to throttle body 64; engine coolant temperature (ECT) from temperature sensor 112 coupled to cooling jacket 114; a measurement of throttle position (TP) from throttle position sensor 117 coupled to throttle plate 66; a measurement of transmission shaft torque, or engine shaft torque from torque sensor 121, a measurement of turbine speed (Wt) from turbine speed sensor 119, where turbine speed measures the speed of shaft 17, and a profile ignition pickup signal (PIP) from Hall effect sensor 118 coupled to crankshaft 13 indicating an engine speed (We). Alternatively, turbine speed may be determined from vehicle speed and gear ratio.

Continuing with FIG. 1, accelerator pedal 130 is shown communicating with the driver's foot 132. Accelerator pedal position (PP) is measured by pedal position sensor 134 and sent to controller 12.

In an alternative embodiment, where an electronically controlled throttle is not used, an air bypass valve (not shown) can be installed to allow a controlled amount of air to bypass throttle plate 62. In this alternative embodiment, the air bypass valve (not shown) receives a control signal (not shown) from controller 12.

Figure 2:
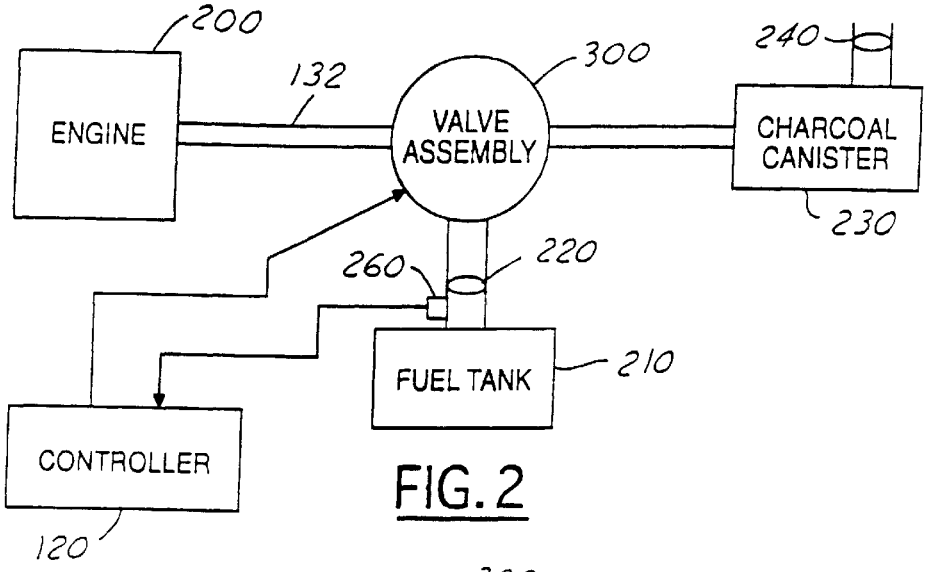
FIG. 2 is a block diagram of an embodiment wherein the invention is used to advantage.

Referring next to FIG. 2, the proposed fuel purge system components are described in detail. Engine 200, which could be a conventional, DISI, HEV or a diesel engine, is connected to fuel tank 210 and charcoal canister 230 via communication passage 132. A gravity valve 220 is used to seal off the tank vent line. Tank pressure sensor 260 provides fuel tank pressure information to controller 12. Charcoal canister 230 is used to store fuel vapors. Intake of outside air into the canister is controlled by canister vent valve 240. Valve assembly 300 is located at the intersection of fuel vapor supply lines from the fuel tank, the engine and the carbon canister. As the pressure inside the fuel tank 210 changes due to fuel vapor generation, the controller 12 receives tank pressure information from pressure sensor 260. When the internal pressure of the tank exceeds a predetermined value, the controller 12 sends signals to the valve assembly 300 to enable fuel vapor storage in the canister, where charcoal granules absorb and retain fuel vapors, while the fresh air component of the vapors is expelled into the atmosphere via canister vent valve 240. When controller 12 determines that conditions for canister purge (e.g., the end of engine adaptive learning cycle, ambient temperature, barometric pressure, etc.) are met, it sends a signal to the valve assembly to enable fuel vapor purge from canister to engine. Valve assembly preferably couples engine to canister only during purging and fuel tank to canister only otherwise to store fuel vapors.

Figure 3:
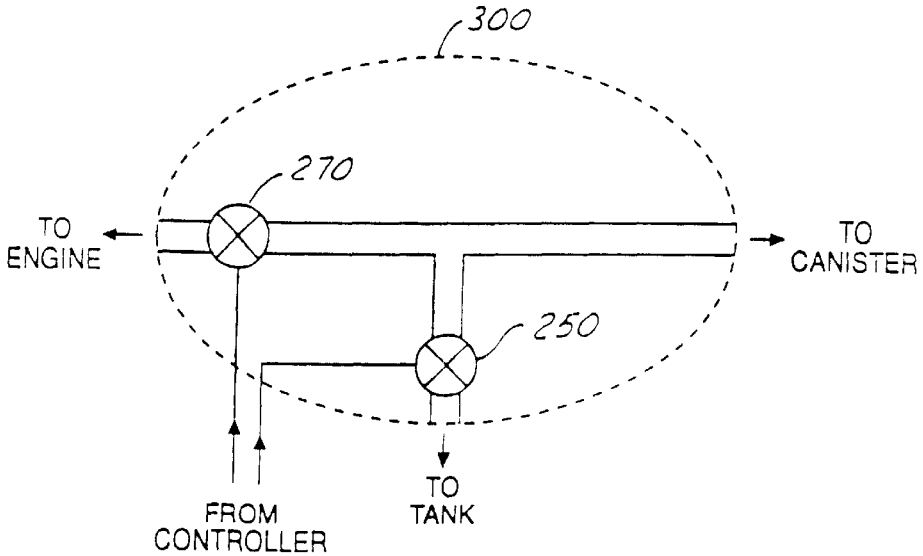
FIG. 3 is an example valve assembly.

Referring now to FIG. 3, an example of the valve assembly components is described in detail. A purge control valve 270 is located on the engine side of the fuel vapor purge control system, and is selectively turned on and off by controller 12. Alternatively, the purge control valve may be continuously controlled thus varying the opening area of the communication passage 132. Tank control valve 250 is used to isolate the fuel tank and is selectively turned on and off by controller 12. When the internal pressure of the tank exceeds a predetermined value, the controller 12 sends signals to close purge control valve 270 and open tank control valve 250 in order to store fuel vapors in the carbon canister. In addition, when canister purge needs to be performed, controller 12 sends a signal to open purge control valve 270 and close tank control 250 thus isolating the fuel tank. With the purge control valve 270 open, intake manifold vacuum draws fresh air from the atmosphere into the charcoal canister, thus purging the vapors from the canister into the engine where they are burned with fresh air. Alternatively, the opening area of the purge control valve 270 can be controlled by controller 12 in response to desired purge flow. Fuel vapors during canister purge into the engine flow in the direction opposite to fuel vapor flow during fuel vapor storage from the fuel tank into the canister.

The example described above is but one exemplary system that can be used. Those skilled in the art will recognize, in view of this disclosure that various other assemblies may be used. For example, a three-way valve could be used in place of the two valves described above. According to the present invention, valve assembly 300 could preferably be any valve assembly that provides the structure of coupling the fuel tank to the canister only, and coupling the engine to the canister only.

Figure 4:
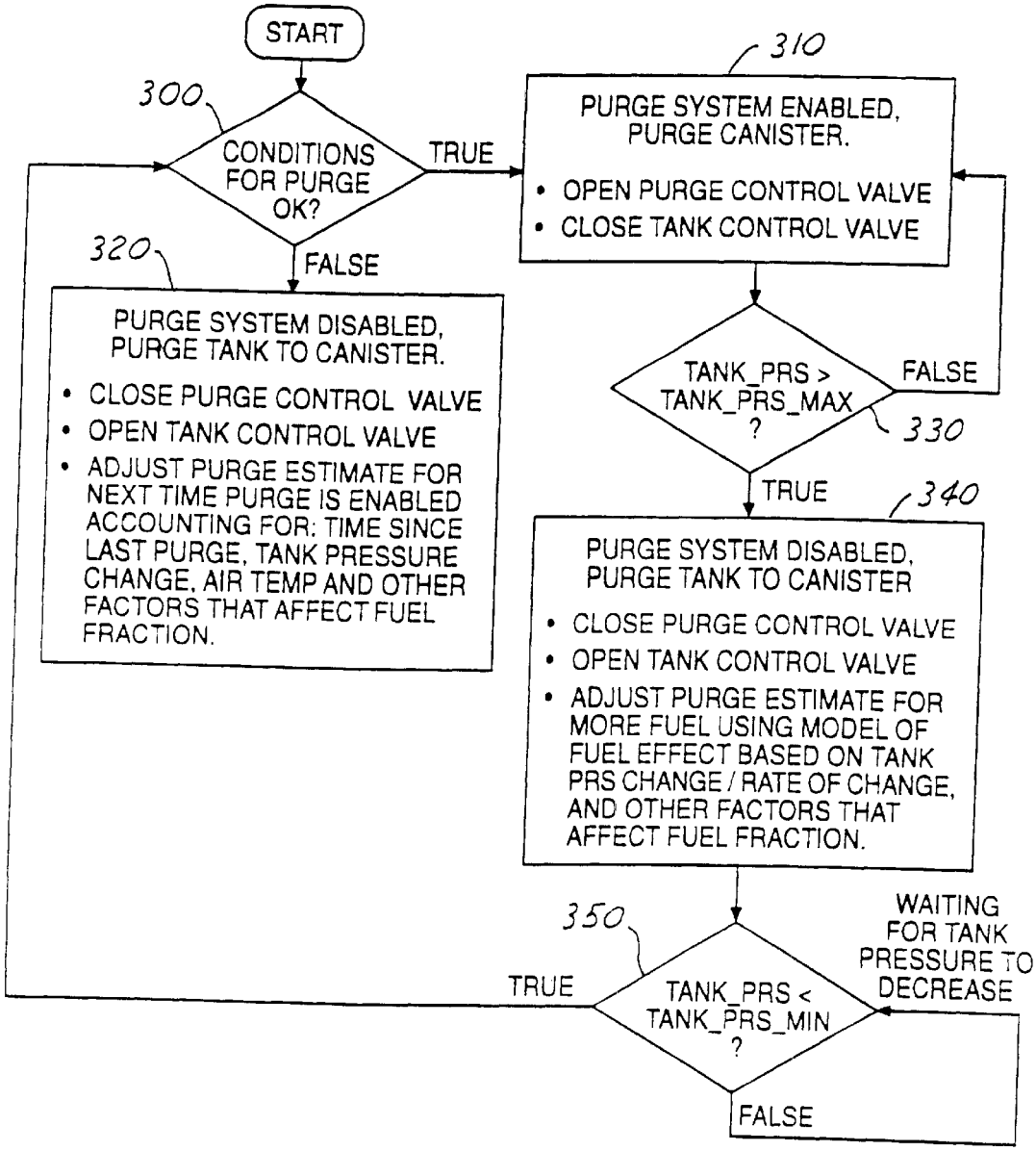
FIG. 4 is a high level flowchart illustrating various program steps performed by a portion of the components illustrated in FIG. 3.

Referring now to FIG. 4, a routine is described for controlling the fuel purge system in the example embodiment. First, in step 300 a determination is made whether the conditions for canister purge are met (e.g., the end of engine adaptive learning cycle, ambient temperature, barometric pressure, etc.). If the answer to step 300 is NO, the routine moves to step 320 where the vapors from the fuel tank are purged to the canister. This is accomplished by closing the purge control valve and opening the tank control valve. Also, purge fuel fraction estimate is adjusted for the next time purge is enabled. This estimate is a function of some or all of the following inputs: ambient temperature, barometric pressure, maximum and minimum tank pressure, time since last purge, time since tank control valve closed, last adapted fraction of fuel coming from the purge canister, tank vapor temperature, tank bulk fuel temperature, and vapor canister temperature. If the answer to step 300 is YES, the routine proceeds to step 310, where the purge system is enabled, and the contents of the canister are purged to the engine. This is accomplished by opening the purge control valve and closing the tank control valve. The routine then proceeds to step 330 whereupon a determination is made whether the internal pressure of the fuel tank, TANK_PRS is greater than a predetermined constant, TANK_PRS_MAX. If the answer to step 330 is NO, the routine returns to step 310, and canister purge continues. If the answer to step 330 is YES, the routine proceeds to step 340, whereupon purge control valve is closed and tank control valve is opened in order to purge the fuel tank to the canister. Also, purge estimate is adjusted for more fuel based on some or all of the following inputs: ambient temperature, barometric pressure, maximum and minimum tank pressure, time since last purge, time since tank control valve closed, last adapted fraction of fuel coming from the purge canister, tank vapor temperature, tank bulk fuel temperature, and canister vapor temperature. The routine then proceeds to step 350 where a determination is made whether the internal pressure of the fuel tank is less than a preselected value, TANK_PRS_MIN. If the answer to step 350 is YES, the routine returns to step 300 and monitoring continues. If the answer to step 350 is NO, the routine remains in step 350, waiting for the fuel tank pressure to decrease.

Figure 5:
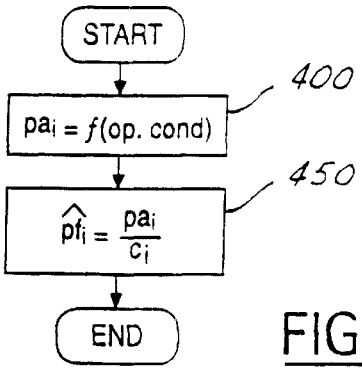
FIGS. 5 and 6 are high level flowcharts illustrating an example of a strategy for learning and adjusting estimates of the fuel fraction as required by FIG. 4.

Next, in FIG. 5, an algorithm for predicting fuel flow through the purge control valve is described. First, in step 400, air flow through the purge control valve, $pa_i$, is calculated as a function of operating conditions, such as valve position, manifold pressure, ambient temperature, barometric pressure, etc. Next, in step 450, predicted fuel flow through the purge control valve, $\hat{p}f_i$, is calculated according to the following formula:

$$\hat{p}f_i = \frac{pa_i}{c_i},$$

where $c_i$ is the learned value of the fuel fraction in the purge vapors which is calculated as described later herein with particular reference to FIG. 6.

Figure 6:
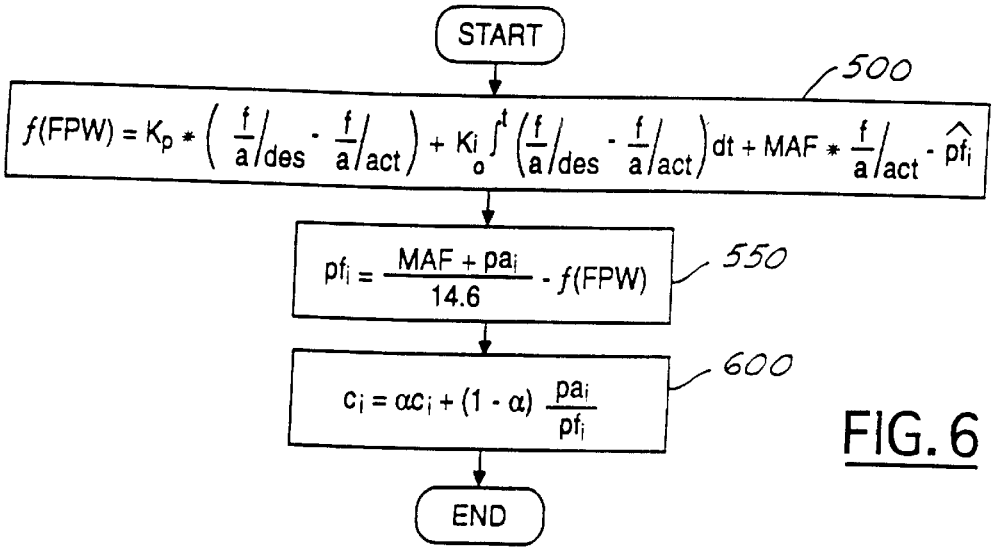
Figure 7:
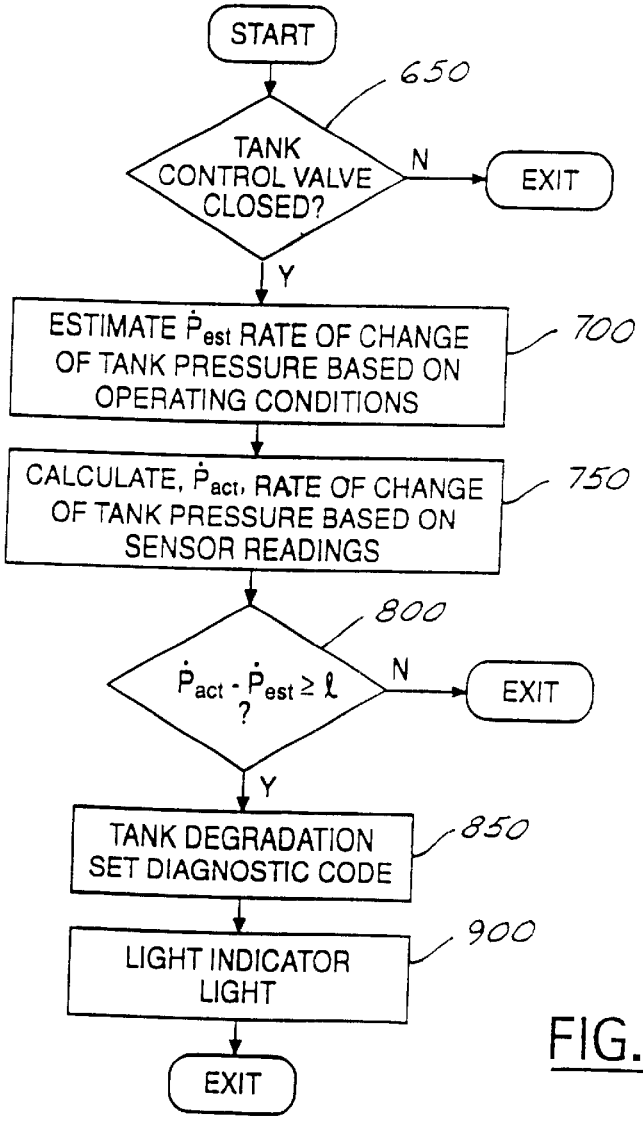
FIG. 7 is a high level flowchart illustrating and example of a strategy for diagnosing a condition of the fuel tank.

Referring now to FIG. 6, an algorithm is described for learning the fuel fraction entering the engine during the canister purge. First, in step 500 fuel flow as a function of fuel pulse width is calculated according to the following formula using a PI controller with a feed forward correction term:

$$f(FPW) = k_p \cdot \left( \frac{f}{a}\bigg|_{des} - \frac{f}{a}\bigg|_{act} \right) + k_i \cdot \int_0^t \left( \frac{f}{a}\bigg|_{des} - \frac{f}{a}\bigg|_{act} \right) dt + MAF \cdot \frac{f}{a}\bigg|_{des} - \hat{p}f_i$$

Next, in step 550 fuel flow through the purge control valve is calculated assuming stoichiometry:

$$pf_i = \frac{MAF + pa_i}{14.6} - f(FPW)$$

where $\hat{p}f_i$ is the fuel flow through the valve, $pa_i$ is the air flow through the purge valve value obtained in step 400 of FIG. 5, MAF is manifold air flow, and $f$(FPW) is fuel flow as a function of fuel pulse width. Next, the learned value of the fuel fraction in the purge vapors, $c_i$, is updated in step 600 according to the following formula:

$$c_i = \alpha \cdot c_i + (1 - \alpha) \cdot \frac{pa_i}{pf_i}$$

Referring now to FIG. 6, a routine is described for diagnosing a condition of the fuel vapor purge system. First, in step 650: a determination is made whether the tank control valve is closed, i.e., the tank is isolated. If the answer to step 650 is NO, the diagnostic routine is exited. If the answer to step 650 is YES, the routine moves on to step 700 where $P_{est}$, the estimated rate of change of internal fuel tank pressure is calculated based on operating conditions, such as ambient temperature, barometric pressure, bulk fuel temperature, etc. The routine then proceeds to step 750 where $P_{act}$, the actual rate of change of the internal pressure of the fuel tank is calculated based on the information from the fuel tank pressure sensor. Next, in step 800 a determination is made whether the actual rate of change exceeds the estimated rate of change by the amount greater than or equal to a small preselected constant, L. If the answer to step 800 is NO, there is no condition of the fuel tank, and the routine is exited. If the answer to step 800 is YES, and there is a difference between the actual and calculated rates of change of fuel tank pressure, a determination is made that there is a condition of the fuel tank, and a diagnostic code is set in step 850. Next, an indicator light for the operator of the vehicle is lit in step 900 and the routine exits.

Thus, according to the present invention, by adding a control valve to seal off the fuel tank during canister purge to the engine, and monitoring the actual rate of change of fuel vapor pressure in the fuel tank as compared to the estimated rate of change, it is possible to detect a fuel tank condition that may cause fuel vapor emission into the atmosphere.

This concludes the description of the invention. The reading of it by those skilled in the art would bring to mind many alterations and modifications without departing from the spirit and the scope of the invention. Accordingly, it is intended that the scope of the invention be defined by the following claims:

What is claimed is:

1. A method for detecting a fuel tank condition in a vehicle, the method comprising:

isolating the fuel tank from a fuel vapor storage device and from an engine;

calculating an estimated rate of change of a fuel tank pressure based on an operating condition when the fuel tank is isolated;

calculating an actual rate of change of said fuel tank pressure when the fuel tank is isolated based on an information from a fuel tank pressure sensor; and indicating the fuel tank condition if said actual rate of change exceeds said estimated rate of change by a value greater than a preselected constant.

2. The method recited in claim 1, wherein said fuel vapor storage device is a carbon canister.

3. The method recited in claim 1, wherein said operating condition is a bulk fuel temperature.

4. The method recited in claim 1, wherein said indicating comprises setting a diagnostic code.

5. The method recited in claim 4, wherein said indicating further comprises lighting an indicator light.

6. The method recited in claim 1, wherein said engine is an internal combustion engine.

7. The method recited in claim 1, wherein said engine is a diesel engine.

8. The method recited in claim 1, wherein said engine is further coupled to an electric motor.

9. A system for diagnosing a fuel vapor purge system comprising:

an engine;

a fuel tank;

a fuel tank pressure sensor;

a fuel vapor storage device;

a valve assembly;

a first controller for controlling said valve assembly to isolate said fuel tank from said fuel vapor storage device and from said engine or to isolate said engine from said fuel vapor storage device and said from fuel tank; and a second controller for calculating an actual rate of change of a fuel tank pressure when said fuel tank is isolated based on an information from said fuel tank pressure sensor; estimating an expected rate of change of said fuel tank pressure when said fuel tank is isolated based on an operating condition; and indicating a fuel tank condition if said actual rate of change exceeds said expected rate of change by a value greater than a preselected constant.

10. The system recited in claim 9, wherein said fuel vapor storage device is a carbon canister.

11. The system recited in claim 9, wherein said first operating condition is an ambient temperature.

12. The system recited in claim 9, wherein said second controller indicates said fuel tank condition by setting a diagnostic code.

13. A system for diagnosing a fuel vapor purge system comprising:

an internal combustion engine;

a fuel tank;

a fuel tank pressure sensor;

a fuel vapor storage device;

a passageway connecting said engine, said fuel tank, and said fuel vapor storage device in a three-way connection;

a purge control valve coupled between said connection and said engine;

a fuel tank control valve coupled between said connection and said fuel tank; and a controller for calculating an actual rate of change of a fuel tank pressure based on an information from said fuel tank pressure sensor when said fuel tank control valve is closed; estimating an expected rate of change of the fuel tank pressure based on an operating condition when said tank control valve is closed; and indicating a fuel tank condition if said actual rate of change exceeds said expected rate of change by a value greater than a preselected constant.

14. The system recited in claim 13 wherein said operating condition is a bulk fuel temperature.

15. The system recited in claim 13 wherein said operating condition is a barometric pressure.

16. The system recited in claim 13 wherein said operating condition is a barometric pressure.

17. The system recited in claim 13 wherein said indicating comprises setting a diagnostic code.

18. The system recited in claim 17 wherein said indicating further comprises lighting an indicator light.

* * * * *